US010015586B2

(12) United States Patent
Shi

(10) Patent No.: US 10,015,586 B2
(45) Date of Patent: Jul. 3, 2018

(54) SPEAKER BOX AND METHOD FOR MANUFACTURING SAME

(71) Applicant: Shengrong Shi, Shenzhen (CN)

(72) Inventor: Shengrong Shi, Shenzhen (CN)

(73) Assignee: AAC TECHNOLOGIES PTE. LTD., Singapore (SG)

( * ) Notice: Subject to any disclaimer, the term of this patent is extended or adjusted under 35 U.S.C. 154(b) by 0 days.

(21) Appl. No.: 15/403,501

(22) Filed: Jan. 11, 2017

(65) Prior Publication Data

US 2018/0027322 A1 Jan. 25, 2018

(30) Foreign Application Priority Data

Jul. 20, 2016 (CN) ..... 2016 1 0576523

(51) Int. Cl.

| | |
|---|---|
| ***H04R 1/20*** | (2006.01) |
| ***H04R 1/28*** | (2006.01) |
| ***H04R 9/06*** | (2006.01) |
| ***H04R 31/00*** | (2006.01) |
| ***G10K 11/162*** | (2006.01) |

(52) U.S. Cl.

CPC ..... *H04R 1/288* (2013.01); *G10K 11/162* (2013.01); *H04R 9/06* (2013.01); *H04R 31/006* (2013.01)

(58) Field of Classification Search

CPC ..... H04R 1/288; H04R 9/06; H04R 31/006

See application file for complete search history.

(56) References Cited

U.S. PATENT DOCUMENTS

| | | | | |
|---|---|---|---|---|
| 9,462,373 | B2 * | 10/2016 | Kulomaki | H04R 1/02 |
| 2009/0200102 | A1 * | 8/2009 | Gilbert | H04R 1/288 181/199 |
| 2012/0141670 | A1 * | 6/2012 | Walther | C22C 38/06 427/180 |
| 2013/0170689 | A1 * | 7/2013 | Guenther | H04R 1/2819 381/350 |
| 2016/0345090 | A1 * | 11/2016 | Wilk | H04R 1/288 |

* cited by examiner

*Primary Examiner* — Brian Ensey

(74) *Attorney, Agent, or Firm* — Na Xu; IPro, PLLC

(57) ABSTRACT

A speaker box includes a housing including a bottom wall and a side wall extending from the bottom wall, and a speaker unit in the housing. The speaker box further includes hard sound-absorbing material for supporting and integrally molded with the side wall. The hard sound-absorbing material forms an accommodation space for accommodating the speaker unit therein. The present disclosure further discloses a method for manufacturing the speaker box mentioned above.

11 Claims, 1 Drawing Sheet

SPEAKER BOX AND METHOD FOR MANUFACTURING SAME

FIELD OF THE INVENTION

The invention is related to electro-acoustic transducers, more particularly to a speaker box used in a portable consumer device.

DESCRIPTION OF RELATED ART

With the coming of mobile internet times, the quantity of intelligent mobile device is rising continuously. Among many mobile equipment, mobile phone is the most common and portable mobile terminal equipment. At present, the function of mobile phone is diversified. One of important functions is that of high quality music, and the miniature speaker in mobile phone is one of the essential conditions of realizing the function of high quality music.

Referring to FIG. 1, a related speaker box 10 includes an upper housing 110, a lower housing 120, a ultrasonic wire 130 and a speaker unit 140, in which, the upper housing 110 is installed on both sides of the speaker unit 140 at top. The upper housing 110 and the lower housing 120 are located opposite to each other. The speaker unit 140 is accommodated in an accommodation space formed between the upper housing 110 and the lower housing 120. The ultrasonic wire is provided on at the location of the upper housing 110, far away from two sides at top of the speaker unit 140, and opposite to both ends of the lower housing. The vibration diaphragm of the speaker unit 140 and the upper housing 110 form front sounding cavity and the vibration diaphragm of the speaker unit 140 and the lower housing 120 form back sounding cavity. Due to the limit of existing process and design, the ultrasonic process or coating process are required to assemble the upper housing 110 and the lower housing 120 into a whole. The wall thickness of the housing after assembling is bigger. In the existing technology, the speaker box 10 manufacture process is complicated. The heat dissipation of the speaker box 10 is poor. Sealing performance is not stable. The housing has no-support and is prone to housing vibration.

Therefore, it is necessary to provide an improved speaker box to overcome above disadvantage.

BRIEF DESCRIPTION OF THE DRAWINGS

Many aspects of the embodiment can be better understood with reference to the following drawings. The components in the drawings are not necessarily drawn to scale, the emphasis instead being placed upon clearly illustrating the principles of the present disclosure. Moreover, in the drawings, like reference numerals designate corresponding parts throughout the several views.

DETAILED DESCRIPTION OF THE EXEMPLARY EMBODIMENT

The present invention will hereinafter be described in detail with reference to an exemplary embodiment. To make the technical problems to be solved, technical solutions and beneficial effects of the present disclosure more apparent, the present disclosure is described in further detail together with the figures and the embodiment. It should be understood the specific embodiment described hereby is only to explain this disclosure, not intended to limit this disclosure.

Figure 1:
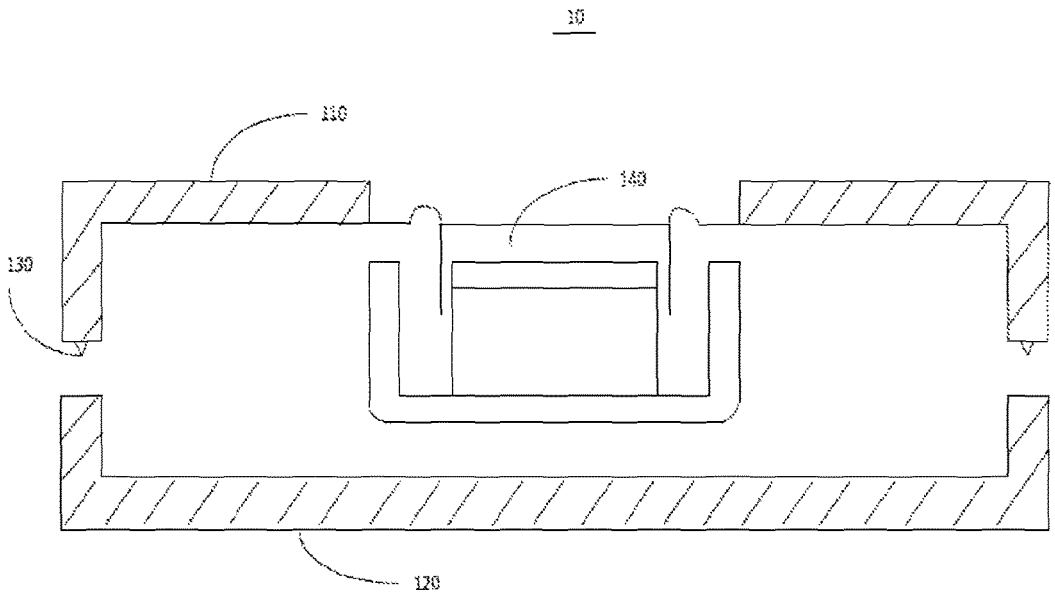
Fig. 1 (Related Art)
FIG. 1 is an illustrative view of a speaker box related to the present disclosure.
Figure 2:
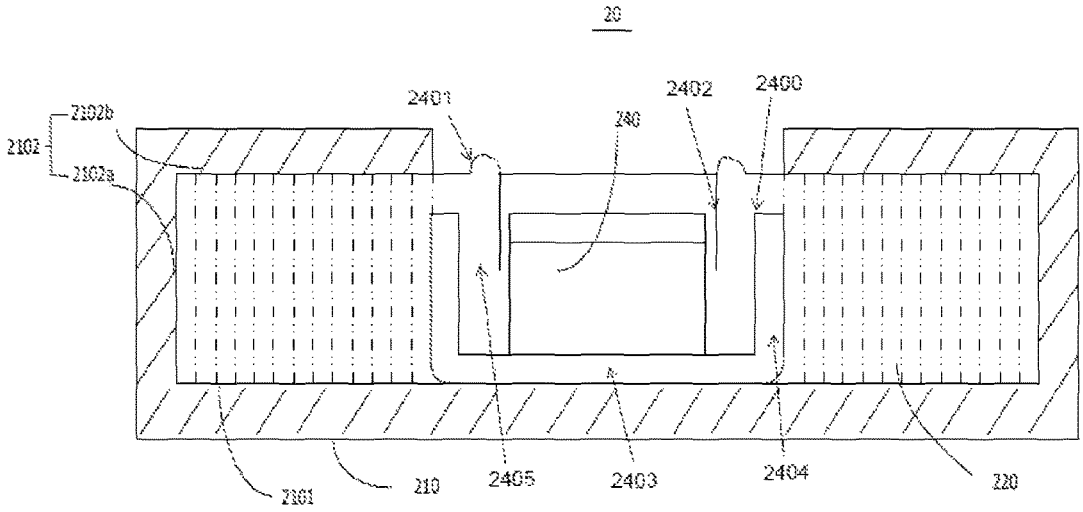
FIG. 2 is an illustrative view of a speaker box in accordance with an exemplary embodiment of the present disclosure.

Refer to FIG. 2, the present invention provides a speaker box 20. The speaker box 20 includes a housing 210 and a speaker unit 240 installed in the housing. The housing 210 includes a bottom wall 2101 and a side wall 2102 extended from the bottom wall 2101. The speaker box 20 also includes hard sound-absorbing material 220 used to support the side wall 2102. The hard sound-absorbing material 220 is provided with an accommodation space to accommodate the speaker unit 240. The hard sound-absorbing material 220 and the side wall 2102 are molded together.

Optionally, the speaker unit 240 includes a vibration system and a magnetic circuit system, in which, the vibration system includes a vibrating diaphragm 2401 and a voice coil 2402 driving the vibrating diaphragm 2401. The magnetic circuit system have a bottom part 2403 away from the vibration diaphragm 2401 and a side part 2404 extending from an edge of the bottom part 2403 towards the vibration diaphragm 2401, the bottom part 2403 and the side part 2404 forming a cavity 2405 with an opening 2400 towards the vibration diaphragm 2401, the voice coil 2402 extending partially 2402 into the cavity 2405, with the bottom part 2403 contacting directly with the bottom wall 2403, and the side part 2404 contacting directly with the hard sound-absorbing material 220.

Optionally, the side wall 2102 includes a side portion 2102*a* extended un-straightly from the bottom wall 2101. In this embodiment, the vibrating diaphragm is fixed on the side portion 2102*a* or the hard sound-absorbing material 220.

Optionally, the side wall 2102 also includes a support portion 2102*b* extended un-straightly from the side portion 2102*a* to the accommodation space. In this embodiment, the vibrating diaphragm is fixed on the support portion 2102*b*.

Optionally, the magnetic circuit system is accommodated in the accommodation space formed by the hard sound-absorbing material 220. Its outer edge contacts directly the hard sound-absorbing material 220.

Optionally, the hard sound-absorbing material 220 is porous material. The opening rate of porous material shall conform to the acoustic characteristics. The opening size is based on the extent that the material can grip effectively on the side wall. In this embodiment, the opening rate of porous material is more than 40%. Certainly, the opening rate of porous material can be increased according to need. The opening rate of porous material is more than 50%. In order to achieve better acoustic characteristics, the opening rate of porous materials can be increased further. The opening rate of porous material is more than 90%, in which, the size of the opening can be up to a few microns, with resistance to injection molding.

Optionally, porous material is porous ceramic, porous glass or porous metal, pure material or composite material in general.

In this embodiment, method to produce the speaker box 20 includes following steps: Providing a mold. Processing hard sound-absorbing material 220 into the required size for filling the mold. The hard sound-absorbing material 220 is put into the mold as one part of the mold. The hard sound-absorbing material 220 is the filling mold. The injection liquid is injected into the mold. The injection liquid and the hard sound-absorbing material 220 are molded into the housing 210. The mold and the housing 210 are separated. The filling mold, namely hard sound-absorbing material

220, is kept inside the housing 210 as sound absorbing material. The speaker unit 240 is assembled into the housing 210.

In this embodiment of the present invention, the hard sound-absorbing material and the side wall of the speaker box are molded together to simplify the speaker box manufacture process, improve the speaker box sealing, increase the cooling performance of the speaker box. As a result of the support of the hard sound-absorbing material, in injection molding, the wall thickness of the housing can be very thin. In same size speaker box, the cavity can be bigger and more hard sound-absorbing material can be placed, so as to improve low frequency performance, get the effective support of the hard sound-absorbing material, to eliminate housing vibration.

It is to be understood, however, that even though numerous characteristics and advantages of the present exemplary embodiments have been set forth in the foregoing description, together with details of the structures and functions of the embodiments, the disclosure is illustrative only, and changes may be made in detail, especially in matters of shape, size, and arrangement of parts within the principles of the invention to the full extent indicated by the broad general meaning of the terms where the appended claims are expressed.

What is claimed is:

1. A speaker box including:

a housing including a bottom wall and a side wall extending from the bottom wall;

a speaker unit in the housing;

hard sound-absorbing material for supporting and integrally molded with the side wall; wherein the hard sound-absorbing material forms an accommodation space for accommodating the speaker unit therein;

wherein, the speaker unit includes a vibration system and a magnetic circuit system, the vibration system including a vibrating diaphragm and a voice coil for driving the vibrating diaphragm, the magnetic circuit system having a bottom part away from the vibration diaphragm and a side part extending from an edge of the bottom part towards the vibration diaphragm, the bottom part and the side part forming a cavity with an opening towards the vibration diaphragm, the voice coil extending partially into the cavity, with the bottom part contacting directly with the bottom wall, and the side part contacting directly with the hard sound-absorbing material.

2. The speaker box as described in claim 1, wherein the side wall includes a side portion extending perpendicularly from the bottom wall.

3. The speaker box as described in claim 2, wherein the side wall further includes a support portion extending from the side portion to the accommodation space.

4. The speaker box as described in claim 2, wherein the vibrating diaphragm is fixed on the side portion or the hard sound-absorbing material.

5. The speaker box as described in claim 3, wherein the vibrating diaphragm is fixed on the support portion.

6. The speaker box as described in claim 1, wherein the hard sound-absorbing material is porous material.

7. The speaker box as described in claim 6, wherein the opening rate of porous material is more than 90%.

8. The speaker box as described in claim 6, wherein the opening rate of porous material is more than 50%.

9. The speaker box as described in claim 6, wherein the opening rate of porous material is more than 40%.

10. The speaker box as described in claim 6, wherein the porous material is porous ceramics, porous glass or porous metal, pure material or composite material in general.

11. A method for manufacturing a speaker box as described in claim 1, comprising the steps of:

providing a mold;

processing the hard sound-absorbing material into a required size and then disposing the hard sound-absorbing material into the mold for forming a mold core inside the mold for the housing;

injecting injection liquid into the mold;

forming the housing by molding the injection liquid and the hard sound-absorbing material;

separating the mold and the housing;

assembling a speaker unit into the housing.

* * * * *